United States Patent [19]

Wagner, Sr.

[11] Patent Number: 4,550,547

[45] Date of Patent: Nov. 5, 1985

[54] METHOD AND APPARATUS FOR ROLLING AND PACKAGING CONVOLUTED FOAM PADS

[75] Inventor: Bill L. Wagner, Sr., Redlands, Calif.

[73] Assignee: Bio Clinic Company, Rancho Cucamonga, Calif.

[21] Appl. No.: 495,600

[22] Filed: May 17, 1983

[51] Int. Cl.[4] ..... B65B 11/56; B65B 61/12; B65B 63/02

[52] U.S. Cl. ..... 53/430; 53/118; 53/436; 53/528; 53/389; 225/100

[58] Field of Search ..... 53/118, 430, 389, 436, 53/528; 156/62.2, 184, 324, 543, 547, 549, 550, 556; 225/100

[56] References Cited

U.S. PATENT DOCUMENTS

| | | | |
|---|---|---|---|
| 2,830,648 | 4/1958 | Haddox | 156/62.2 |
| 3,672,551 | 6/1972 | Peterson | 225/100 |
| 3,813,843 | 6/1974 | Wooldridge et al. | 53/118 |
| 3,927,504 | 12/1975 | Forrister | 53/430 |
| 3,964,235 | 6/1976 | Miller et al. | 53/118 |
| 4,118,022 | 10/1978 | Rayfield et al. | 225/100 |
| 4,261,497 | 4/1981 | Roetter et al. | 225/100 |
| 4,284,221 | 8/1981 | Nagel et al. | 225/100 |

*Primary Examiner*—Robert L. Spruill
*Assistant Examiner*—Michael D. Folkerts
*Attorney, Agent, or Firm*—Austin R. Miller

[57] ABSTRACT

Apparatus and method are provided for producing a compressed, rolled package of resilient foam material. wrapped with a flexible sheet material which is divided into a plurality of sections separated by pre-weakened areas along its length. The flexible sheet material is advanced by an upstream set of clutch-brake nip rolls and a downstream set of drive nip rolls. The two sets of nip rolls are operated in such a manner as to separate a single wrapping sheet from the length of flexible sheet material and to advance the single sheet into contact with the foam piece for feeding to a rolling and compressing packaging apparatus.

10 Claims, 3 Drawing Figures

METHOD AND APPARATUS FOR ROLLING AND PACKAGING CONVOLUTED FOAM PADS

BACKGROUND OF THE INVENTION

1. Field of the Invention

This invention relates to an apparatus and method for quickly and completely automatically producing a compressed, rolled package of resilient foam material. The invention utilizes a unique wrapper sheet delivery system whereby adhesive is applied to one surface of the wrapper sheet. The foam product and the wrapper sheet are then compressed and rolled. The wrapper sheet adheres to the circumference of the foamed material package, and to itself, to maintain the package in a tightly rolled and compressed state.

2. Description of the Prior Art

U.S. Pat. No. 3,927,504 discloses a method and apparatus of making a compressed, rolled package of resilient compressible foamed sheet material wherein a cylindrical roller engages and compresses an edge of the foamed sheet material causing the foam material behind the roller to curl up and fold over upon itself. Directly behind the cylindrical roller is a carrier which continues the pressurized engagement with the rolling foamed material and continues the rolling of the package until it is formed into a compressed rolled package. This patent further discloses the wrapping of the compressed rolled foam material with a plastic wrapping sheet to maintain the package in a compressed rolled state.

The apparatus of this patent utilizes a stationary table 10 upon which a foam sheet (S) and a wrapping sheet (W) are manually placed and arranged for subsequent rolling and wrapping. The rolling and wrapping operation is accomplished by advancing carrier 20, having cylindrical roll 35 at its leading edge, over the foam sheet and wrapper sheet respectively. The typical operation of this apparatus is to have a workman place and position the foam sheet and the wrapper sheet on the table and then to activate the moving carrier (20) to perform the rolling and wrapping operation.

U.S. Pat. No. 3,710,536 discloses a method and apparatus for automatically compressing and banding a stack of compressible articles. A stack of articles is fed along a path and a pair of banding or wrapping sheets are brought into engagement with the stack. The stack is compressed between oppositely directed forces and the ends of the wrapping sheets are overlapped and joined to form an endless band around the articles. When the compressive forces are relieved, the articles are held in a compressed and stacked state by the wrapping sheets. The individual wrapping sheets are severed from long supply webs, separated into sections by score lines, perforations or other types of pre-weakened areas, prior to being joined into an endless band around the compressed stack.

SUMMARY OF THE INVENTION

Thus, it is an object of the present invention to provide a method and apparatus for completely automatically packaging a rolled and compressed foam piece with a flexible sheet material.

It is a further important object of the present invention to utilize a long length of flexible wrapping sheet material, in the form of a roll of flexible sheet material, divided into a plurality of sections separated by pre-weakened areas along its length.

It is a still further important object of the present invention to provide a method and apparatus for automatically feeding such a flexible sheet material, in the form of a rolled length which is divided into a plurality of sections separated by pre-weakened areas, and automatically separating and feeding individual wrapper sections from the length of flexible sheet material for wrapping a rolled and compressed foam piece.

These and other objects are met by a method and apparatus for packaging a rolled and compressed foam piece with a flexible sheet material wherein the flexible sheet material is fed to an upstream set of clutch-brake nip rolls and engaging the clutch-brake nip rolls to feed the flexible sheet material to a downstream set of drive nip rolls. The flexible sheet material is guided during its travel between the two set of nip rolls. After the drive nip rolls have engaged the leading edge of the flexible sheet material, the brake in the clutch-brake nip rolls engages which exerts a drag on the advancing sheet material. This drag creates a tension on the flexible sheet material which is sufficient to tear it along a pre-weakened area. As soon as a pre-weakened area advances to a position between the two sets of nip rolls, the sheet material tears at the pre-weakened area and a separated single wrapper section is advanced by the drive nip rolls apart from the remainder of the flexible sheet material.

Figure 1:
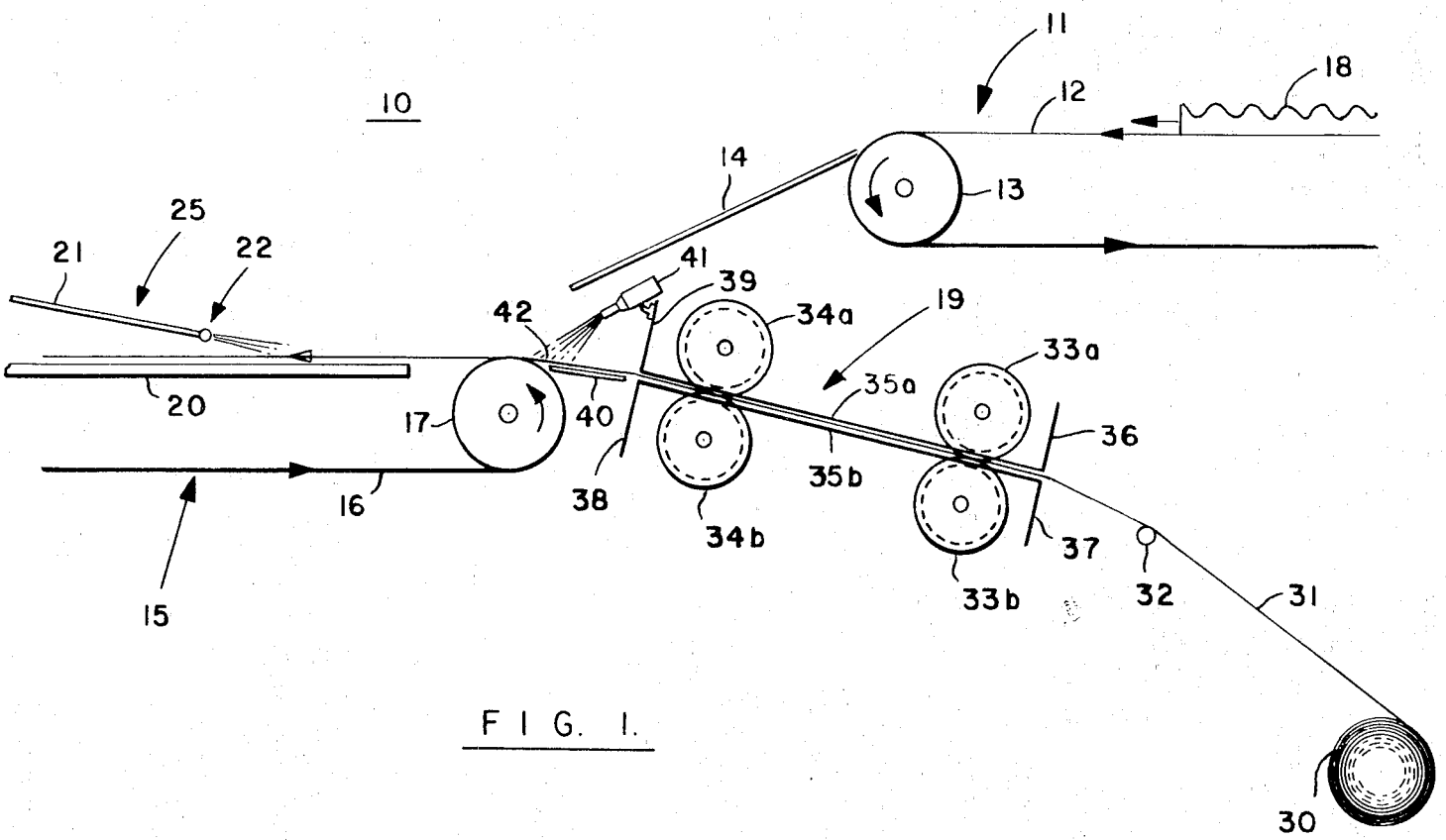
FIG. 1 is a side elevation of an apparatus comprising one specific embodiment of the present invention.

Although specific forms of apparatus embodying the invention have been selected for illustration in the drawings, and although specific terminology will be resorted to in describing those forms in the specification which follows, their use is not intended to define or to limit the scope of the invention, which is defined in the appended claims.

DESCRIPTION OF THE PREFERRED EMBODIMENTS

Referring to FIG. 1 the packaging apparatus is designated as 10. Furthermore, with respect to the packaging apparatus 10 and/or any individual part thereof, the side or end closest to the convolutor shall be designated upstream, and the side or end closest to the rolling device shall be designated downstream.

In the method and apparatus illustrated in the figures, the foam piece is a convoluted foam pad 18 which is manufactured in a well-known manner by feeding a sheet of foam material into a convoluter (not shown in the figures). In the convoluter, the foam sheet material is cut into two convoluted foam pads 18 which are then fed to conveyor belts which move the pads downstream to the rolling and packaging apparatus 10. Thus, as one convoluted foam pad 18 exits from the convoluter it is fed, convoluted side up, onto endless belt 12 of conveyor 11 which is driven in a known manner by drive roller 13. Upon reaching the end of conveyor 11, the foam pad 18 is deposited on, and slides down, metal ramp 14 onto conveyor 15 comprised of an endless belt 16 driven by drive roller 17.

At the same time that convoluted foam pad 18 is being conveyed along conveyors 11, 15 and ramp 14, the wrapper feed device 19 is activated to advance a plastic wrapper section 42 into adhesive contact with the flat or non-convoluted side of the foam pad 18. Preferably, the plastic wrapping material is in the form of a continuous roll 30 of perforated plastic sheet material. The plastic sheet 31 is divided into individual wrapper sections by perforations running across the width of the plastic sheet 31. A preferable plastic sheet material is polyethylene or polyurethane.

Thus, in a known manner, the plastic sheet 31 is unwound from roll 30 and runs over idler roller 32 to the wrapper feed device 19. Wrapper feed device 19 comprises two sets of nip rolls; an upstream set of clutch-brake nip rolls 33*a, b* and a downstream set of drive nip rolls 34*a, b*. Both sets of nip rolls 33 and 34 are preferably composed of neoprene rubber of 35 dural hardness. In typical packaging operations the nip rolls 33, 34 will have a diameter of approximately 4 inches and a length of approximately 4 feet.

Figure 2:
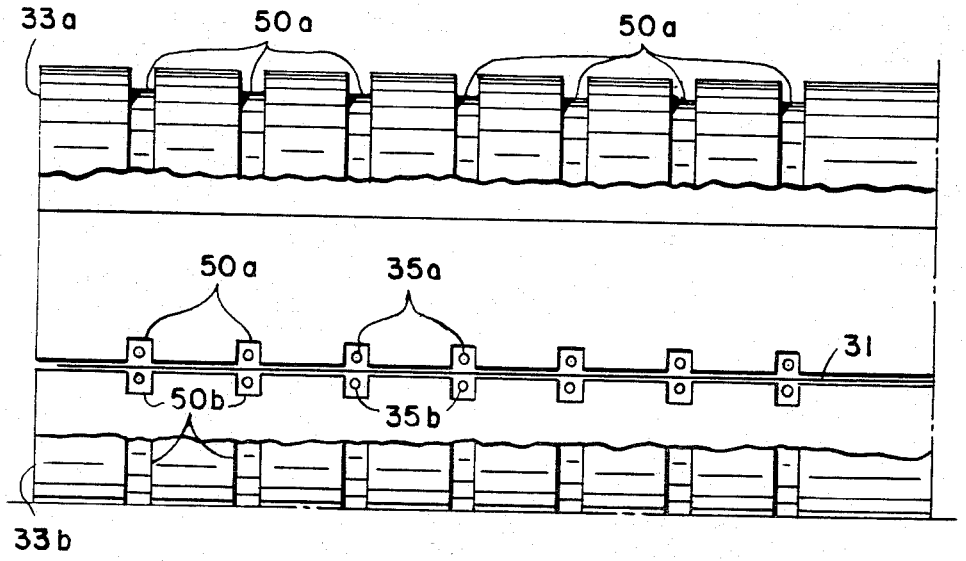
FIG. 2 is a side elevation, partly in section, of a set of nip rolls according to the present invention.

Referring now to FIG. 2 of the drawings, the set of clutch-brake nip rolls 33 is illustrated from a side view, shown partly in section. Although the set of clutch-brake nip rolls 33 was chosen for further illustration in FIG. 2, the set of drive nip rolls 34 has the same shape and configuration so that many of the features of clutch-brake nip rolls 33 shown in FIG. 2 are also present in the drive nip rolls 34. As can be seen, nip roll 33*a* has a plurality of grooves 50*a* in its surface. Grooves 50*a* run completely around the circumference of the roll 33*a*. Likewise, roll 33*b* has a plurality of grooves 50*b* in its outer surface. The depth of the grooves 50*a* and 50*b* is typically 0.25 inches. The width of the grooves 50*a* and 50*b* is typically 0.125 inches. Successive grooves are spaced approximately 1.5 inches apart along the length of each roll 33*a, b*. As can be seen in FIG. 2, the number, position and spacing of the grooves 50*a* exactly corresponds with the number, position and spacing of the grooves 50*b* so that the grooves 50*a* and 50*b* are exactly adjacent one another at the nip point of the clutch-brake rolls 33*a, b*.

Positioned within the grooves 50*a* are a plurality of guide wires 35*a*, one guide wire 35*a* positioned in each groove 50*a*. Likewise, a plurality of guide wires 35*b* are each positioned in grooves 50*b*. As can be seen in FIG. 1, the guide wires 35*a* and 35*b* provide a path for the advancing plastic sheet 31 between the two sets of nip rolls 33, 34. The guide wires are supported at their ends by attachment to supports 36, 37, 38 and 39 in a known manner.

Attached to the downstream side of support 39 are a plurality of adhesive sprayers 41 positioned to spray adhesive on the wrapper sections 42.

In the operation of the wrapper feed device 19, the plastic sheet 31 is unrolled from roll 30 over idler roller 32 to the set of clutch-brake nip rolls 33*a, b*. At this point, the clutch-brake nip rolls 33*a, b* engage to feed the plastic sheet 31 toward the downstream set of drive nip rolls 34*a, b. During the advance of the sheet 31 between the two sets of nip rolls 33, 34, the plastic sheet 31 is guided between the two sets of guide wires 35a, b.* When the forward edge of the plastic sheet 31 reaches the nip between the drive nip rolls 34*a, b* the clutch of the clutch-brake rolls disengages and the downstream edge of sheet 31 is taken up by the drive nip rolls 34*a, b*. After the clutch of the clutch-brake rolls 33*a, b* disengages, the brake on the clutch-brake rolls 33*a, b* engages thereby exerting a drag on the advancing sheet material 31. The tension exerted on the sheet material 31 by the drive nip rolls 34*a, b* and the braked clutch-brake rolls 33*a, b* is sufficient to tear the plastic sheet material 31 across the perforations but is insufficient to tear the plastic sheet material in any other areas. Thus, as soon as a line of perforations advances to a point between the two sets of nip rolls 33, 34, the sheet material 31 will tear along the perforations and a single wrapper section 42 will be advanced by the drive nip rolls 34*a, b*. As the single section 42 advances beyond nip rolls 34*a, b*, it is sprayed with adhesive by the adhesive sprayer 41 while supported by support 40. Thus the single wrapper section 42, having one side thereof sprayed with adhesive, is deposited on the endless belt 16 of conveyor 15.

The advance of the single wrapper section 42 is timed such that the trailing portion of convoluted foam pad 18 is dropped off of ramp 14 onto the leading portion of the individual wrapper section 42. Since the entire surface of the wrapper sheet 42 is coated with adhesive, the area of overlap between the convoluted foam pad 18 and the single wrapper section 42 provides adhesive contact between the convoluted foam pad 18 and the single wrapper section 42 which are then conveyed by endless belt 16 to rolling device 25.

Figure 3:
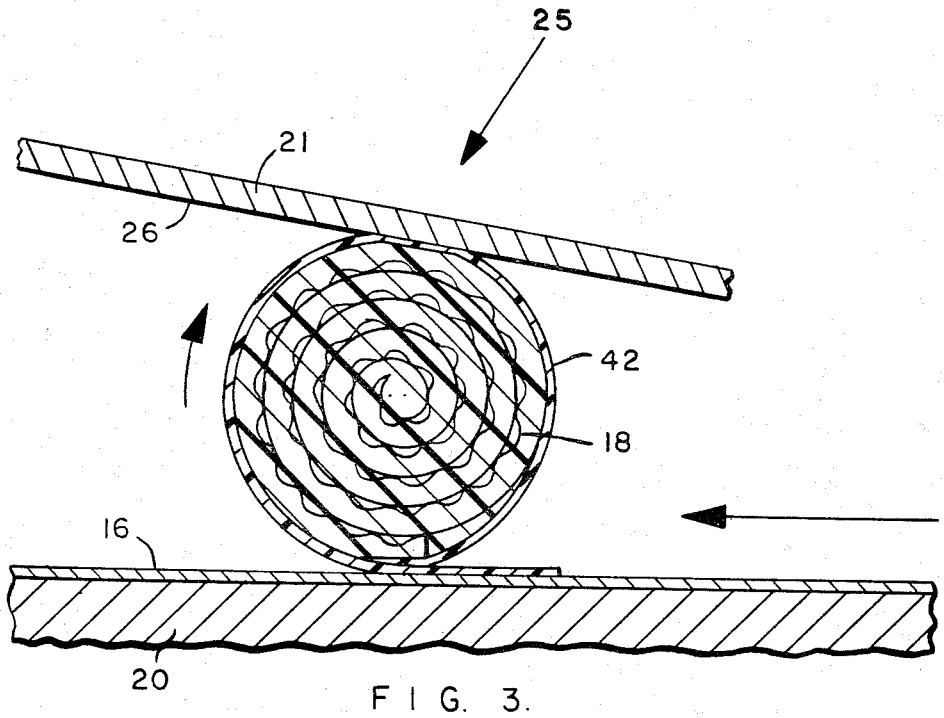
FIG. 3 is a side elevation of a rolled and compressed foam piece just prior to completion of the rolling operation.

Referring to both FIGS. 1 and 3, rolling device 25 comprises a stationary inclined plate 21 having a roughened surface 26 on its lower side. At the upstream edge of inclined plate 21 is positioned an air delivery tube 22 having a plurality of jets spaced along the length of the tube 22. The purpose of the air jets is to ensure that the plastic wrapper sheet 42 lies flat on the endless belt 16. Sometimes, during operation of the machine, the force of the spray from the adhesive sprayers will cause the trailing edges of the individual wrapper sections 42 to fold over. Thus, the air jets spaced along the upstream edge of plate 21 assures that the upstream portion of section 42 lies flat on endless belt 16.

Immediately below endless belt 16 in the region of inclined plate 21 is a support table 20. Support table 20 is provided to prevent deflection of endless belt 16 during the compression rolling of convoluted foam pad 18, which will be described in more detail hereinafter.

The height between the upstream edge of incline plate 21 and the endless belt 16 is adjusted for the particular size convoluted pad 18 being rolled and in any event is somewhat less than the height of the convoluted pad 18. Thus, as the downstream edge of convoluted pad 18 encounters the upstream edge of the incline plate 21, the pad 18 is forced to curl up and roll over on itself in a known manner as shown in U.S. Pat. No. 3,927,504 which is incorporated herein by reference. Furthermore, the angle of inclination of plate 21 is adjusted so that the pad 18 is continuously rolled under a substantially uniform compression into a tightly rolled and compressed package as is clearly shown in FIG. 3.

It will be appreciated that the incline plate 21 may be constructed of wood or any other desirable material. However, it is preferable to provide it with a roughened surface 26 in order to prevent any sliding movement of the foam pad 18 or of the wrapper sheet 42 during the rolling operation. As is clearly shown in FIG. 3, the wrapper sheet 42 having one face thereof completely covered with adhesive, is in contact with, and adheres to, the foam pad 18 along its entire circumference and prevents any loss of compression in the compressed foam roll after the compressed and rolled package has been freed from between the incline plate 21 and the endless belt 16 for further handling.

A typical further handling step is to heat seal the open ends of the wrapper sheet 42 with a hot wire sealing device (not shown).

It will be appreciated that many other modifications may be made without departing from the scope of this invention. For example, certain parts may be used independently of others, parts may be reversed, and equivalent elements may be substituted for those selected for illustration in the drawings, all without departing from the spirit and scope of the invention as defined in the appended claims.

We claim:

1. In a method of packaging a rollable and compressable foam pad with a continuous flexible sheet material divided into a plurality of sections separated by transverse pre-weakened lines, the sections having a length greater than the circumference of the foam pads when the pad is in a rolled and compressed condition and a width greater than the length of the foam pad when the pad is in a rolled and compressed condition, the steps comprising:

a. feeding the continuous flexible sheet material to a set of clutch-brake nip rolls;

b. engaging the clutch-brake nip rolls to feed the continuous flexible sheet material into a set of drive nip rolls;

c. guiding the flexible sheet material during its travel between the nips of the clutch-brake nip rolls and the drive nip rolls;

d. braking the clutch-brake nip rolls while the drive nip rolls are engaged in advancing the continuous flexible sheet material, so that a tension is exerted on the continuous sheet material sufficient to tear the sheet material along the transverse pre-weakened line and separate a single section from the length of the continuous sheet material;

e. synchronously feeding the foam pad, in a non-compressed condition, and the separated single section in a predetermined direction and into adhesive contact such that a trailing portion of the pad in said direction of feeding adheres to a leading portion of the separated single section; and f. rolling and compressing the foam pad thereby causing the single section to completely wrap around the exterior of the pad and maintain the pad in a rolled and compressed condition.

2. The method as described in claim 1, wherein the continuous flexible sheet material is perforated plastic sheet.

3. The method as described in claim 1, wherein the flexible sheet material is perforated polyurethane sheet.

4. The method as described in claim 1, wherein the foam pad is a convoluted foam pad.

5. In an apparatus for packaging a rollable and compressable foam pad with a continuous flexible sheet material divided into a plurality of sections separated by transverse pre-weakened lines, the sections having a length greater than the circumference of the foam pad when the pad is in a rolled and compressed condition and a width greater than the length of the foam pad when the pad is in a rolled and compressed condition, the elements comprising:

a. means for feeding the flexible sheet material to a set of clutch-brake nip rolls;

b. means for engaging the clutch-brake nip rolls to feed the flexible sheet material into a set of drive nip rolls;

c. means for guiding the flexible sheet material during its travel between the nips of the clutch-brake nip rolls and the drive nip rolls;

d. means for braking the clutch-brake nip rolls while the drive nip rolls are engaged in advancing the flexible sheet material, so that a tension is exerted on the sheet material sufficient to tear the sheet material along the pre-weakened line and separate a single section from the length of the sheet material;

e. means for synchronously feeding the foam pad, in a non-compressed condition, and the separated single section in a predetermined direction and into adhesive contact such that a trailer portion of the pad in said direction of feeding adheres to a leading portion of the separated single section; and f. means for rolling and compressing the foam pad thereby causing the single section to completely wrap around the exterior of the pad and maintain the pad in a rolled and compressed condition.

6. The apparatus as described in claim 5, wherein the continuous flexible sheet material is perforated plastic sheet.

7. The apparatus as described in claim 5, wherein the flexible sheet material is perforated polyurethane sheet.

8. The apparatus as described in claim 5, wherein the foam pad is a convoluted foam pad.

9. The apparatus as described in claim 5, wherein the means for guiding the continuous flexible sheet material comprises a plurality of guide wires adjacent a direct path between the nips.

10. The apparatus as described in claim 5, wherein each clutch-brake roll and each drive roll has a plurality of grooves in its surface, and wherein the means for guiding the flexible sheet material comprises a plurality of guide wires, each of the guide wires being positioned adjacent a direct path between the two nips, a portion of each guide wire being positioned in a clutch-brake nip roll groove and a portion of each guide wire being positioned in a drive nip roll groove.

* * * * *